US007308927B2

(12) United States Patent
Lai

(10) Patent No.: US 7,308,927 B2
(45) Date of Patent: Dec. 18, 2007

(54) WINDOW BLIND SYSTEM

(76) Inventor: Tony Lai, 19223 E. Colima Rd., Suite 750, Rowland Heights, CA (US) 91748

( * ) Notice: Subject to any disclaimer, the term of this patent is extended or adjusted under 35 U.S.C. 154(b) by 327 days.

(21) Appl. No.: 10/970,644

(22) Filed: Oct. 20, 2004

(65) Prior Publication Data

US 2006/0081342 A1 Apr. 20, 2006

(51) Int. Cl.
*E06B 3/48* (2006.01)
*E06B 9/305* (2006.01)
*E06B 9/307* (2006.01)

(52) U.S. Cl. ..... 160/116; 160/173 R; 160/177 R

(58) Field of Classification Search ..... 160/115, 160/116, 168.1 R, 174 R, 176.1 R, 177 R, 160/178.1 R, 178.3, 173 R
See application file for complete search history.

(56) References Cited

U.S. PATENT DOCUMENTS 5,092,387 A * 3/1992 King et al. ..... 160/176.1 R
6,648,048 B2 * 11/2003 Lai ..... 160/115
7,100,664 B2 * 9/2006 Hsu ..... 160/115
2006/0021716 A1 * 2/2006 Liang ..... 160/168.1 R

* cited by examiner

*Primary Examiner*—Brian E. Glessner
*Assistant Examiner*—Russell Bloodgood
(74) *Attorney, Agent, or Firm*—Raymond Y. Chan; David and Raymond Patent Group

(57) ABSTRACT

The present invention discloses a window blind system, comprising a shading arrangement and an alternating hanging device vertically extended downwardly to support a plurality of slats in position, wherein a predetermined portion of the slats are both supported by the first shading arrangement and the alternating hanging device, so that by operating the alternating hanging device, the predetermined portion of the slats supported by the alternating hanging device are capable of being displaced with respect to the remaining slats thus creating a varying shading effect.

3 Claims, 10 Drawing Sheets

WINDOW BLIND SYSTEM

BACKGROUND OF THE PRESENT INVENTION

1. Field of Invention

The present invention relates to a window blind, and more particularly to a compound window blind system equipped with different sized hanging arrangements for providing multiple shading effects.

2. Description of Related Arts

Blind and the like such as drapes and portieres are commonly used for sheltering window, separating spaces, and etc., since they are easily maneuverable and aesthetically appealing. Most of the blind comprise a traverse supporter adapted to be affixed to a ceiling, a sliding track mounted on a bottom of the traverse supporter, and a plurality of slats horizontally and suspendedly supported by hanging nets respectively in such a manner that, by operating a pulley system, the slats are shift in a vertical movable manner, or individually rotated at the same time.

However, the blind has several drawbacks. When the blind is opened, sunlight can directly enter the window that is not only heating up the interior of a house but also unpleasing to people's eye. On the other hand, when the blind is fully closed, it blocks all the sunlight effectively. Then, people may alternatively need to turn on the light lamp in order to brighten up the house. Furthermore, the user has no privacy at all because the interior of the house is easily viewed from outside when the blind is opened, so that people may merely close the blind for privacy and security or open the blind for enjoying the sunlight.

Besides, when the blind is fully opened, the sunlight is allowed to enter the house through a plurality of slat gaps. However, the size of the slat gap is predetermined by the manufacturer so that the user may have no other alternation. In order to allow more sunlight passing through the blind, the slat gap must be increased intentionally such that the width of the slat must be increased correspondingly for covering up the widen slat gap when the blind is closed.

In short, since the conventional window blind bears serious drawbacks, the users have to make a decision between sunshine and privacy. Based on this situation, an amended window blind, which is capable of providing multifunctional shading effects, have emerged into existence nowadays. This multifunctional window blind comprises two independent shading systems extended downwardly from the top traverse supporter, wherein two shading system comprises respective hanging arrangement for horizontally and rotationally supporting respective set of slats. Meanwhile, the two shading systems are vertically disposed at the same time to provide an alternate design for creating multiple shading effects. This is to say, the alternate design ensures each slat supported by the first hanging arrangement of first shading system is positioned adjacent to a slat supported by the second hanging arrangement of second shading system. In other words, the user could independently adjust each set of two hanging arrangement to control the distance between first set of slats and second set of slats, thus controlling the blind gap.

Ordinarily, the hanging arrangement of window blind comprises at least an elongated ladder-shaped hanging net having a plurality of grids into which a blind slat is inserted to be supported. The ladder-shaped hanging net comprises two longitudinal cords and a plurality of traverse cords spacedly connected the two longitudinal cords to form a plurality of identical grids between two longitudinal cords for supporting the blind slats. Here, in this multifunctional window blind, the distance between any two slats (respectively belong to the first and the second shading system) is as same as the distance between two slats of a conventional window blinds.

As a result, under the normal circumstance, this multifunctional window blind just looks like a conventional window blind. However, in case of either set of shading system is operated, this amended window blind is capable of allowing lights penetrate into the interior from a distance range from regular gap (distance between neighboring slats of conventional window blind) to a distance twice as large as the regular gap.

This is to say, in order to allow light penetrate from a wider gap, the size of grids of this multifunctional window blind are designed to have a bigger size, preferably, twice as the size as conventional window blind.

However, this kind of amended duplex window blind are not compatible with standardized size of conventional window blinds. As mentioned above, the hanging net grids of this amended window blind are twice as the size of the grid units of conventional window blinds. In other words, in this multifunctional window blind, the hanging net grid of this kind of shading system has a doubled size in comparison with the hanging net grid of conventional window blinds. In addition, this kind of multifunctional window blinds requires vertically and simultaneously disposing two individually operated blind system together for ensuring that one set of blind slats must be adjacent to another set of blind slats belong to another shading system. This is unfortunate for those manufacturers as well as assembling workers since its assembling process is so awesome and laborious thus causing the production costs of this kind of multifunctional window blind rather high.

Conclusively, it is desirable to further amend this kind of multifunctional window blinds arrangement.

SUMMARY OF THE PRESENT INVENTION

A primary object of the present invention is to provide a window blind system which is capable of providing multiple shading effects, wherein the assembling process is simple, the components are standardized for amending above mentioned multifunctional window blinds arrangement.

Another object of the present invention is to provide a window blind system, which comprises at least two shading arrangement for cooperatively controlling one set of blind slats so as to selectively shade the intensity of sunlight entering into the interior room.

Another object of the present invention is to provide a window blind system, wherein a predetermined section of the set of the slat slats can be independently operated by the second operating system such that the compound window blind is capable of providing different shading effects.

Another object of the present invention is to provide a window blind system, wherein two shading arrangement are compatible with the standards of conventional window blinding system, in such way, the compound window blind of the present invention could act as an amended mode to conventional window blind without changing any standard size of conventional window blind.

Another object of the present invention is to provide a window blind system, wherein the operation system is simple and efficient, only a single operating member is provided for controlling both the open/close and light intensity adjusting function. Therefore, the maneuverability of this window blinding system is efficient and effective.

Another object of the present invention is to provide a window blind system which is capable of achieving all features of conventional blind such as easy operation, less expensive, sunlight softening, privacy protection, and aesthetic appearance. In other words, the present invention is an all-in-one window blinding system.

Another object of the present invention is to provide a window blind system, wherein no expensive and complicated structure is employed in the present invention in order to achieve the above mentioned objects. Therefore, the present invention successfully provides an economic and efficient solution for providing multiple shading effects.

Accordingly, in order to accomplish the above objects, the present invention provides a window blind system, which comprises a top traverse supporter adapted for affixing to a top beam of a ceiling, a first shading arrangement, a second shading arrangement;

The first shading arrangement, which is downwardly extended from the top traverse supporter, comprises a first base member, a plurality of slats, a first hanging system for spacedly and suspendedly supporting the slats horizontally between the top traverse supporter and the first base member and for controlling a tilt angle of each of the slats, and a first operating system for selectively lifting up the first base member towards the top traverse supporter and unlifting the first base member to drop downwardly away from the top traverse supporter;

The second shading arrangement, which is downwardly extended from the top traverse supporter, comprises a second hanging system for spacedly and suspendedly supporting a predetermined portion of the slats horizontally between the top traverse supporter and the first base member, a second operation system for lifting up the second hanging system towards the top traverse supporter, so that the predetermined portion of the slats are capable of being lifted for selectively allowing a light of desirable intensity passing through from one side to another side of said wind blind system.

These and other objectives, features, and advantages of the present invention will become apparent from the following detailed description, the accompanying drawings, and the appended claims.

DETAILED DESCRIPTION OF THE PREFERRED EMBODIMENT

Figure 1:
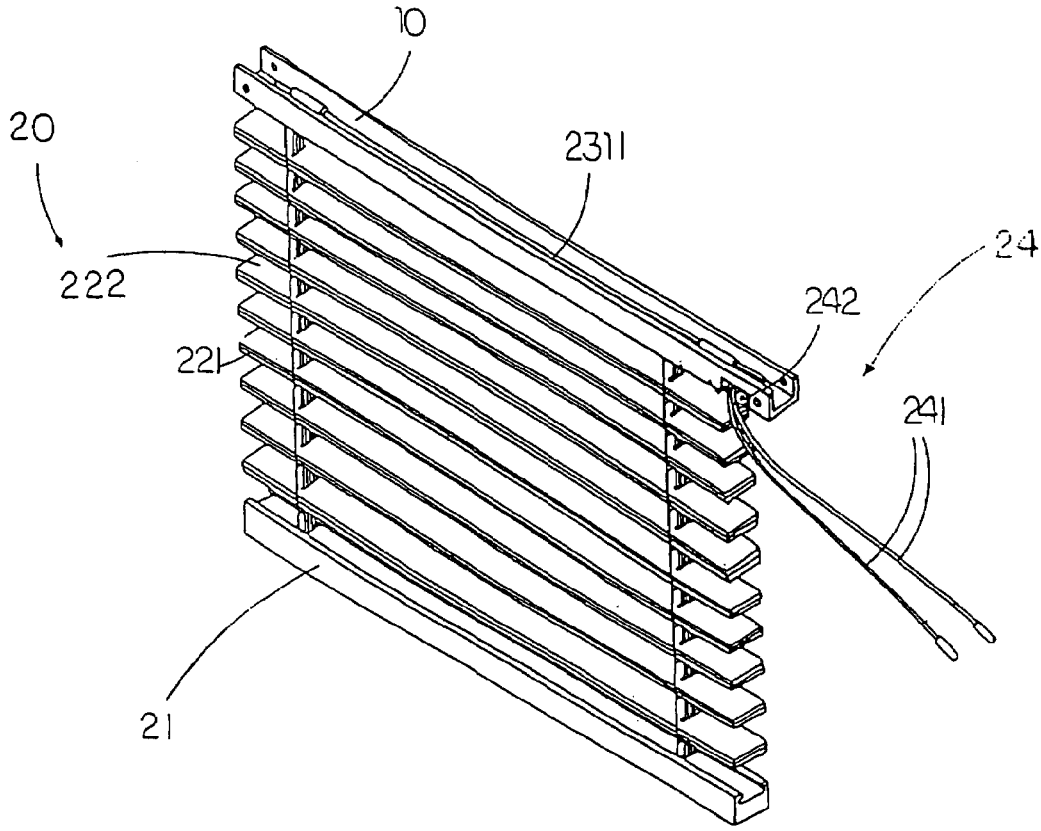
FIG. 1 is a perspective view of a window blind system according to a preferred embodiment of the present invention.
Figure 2:
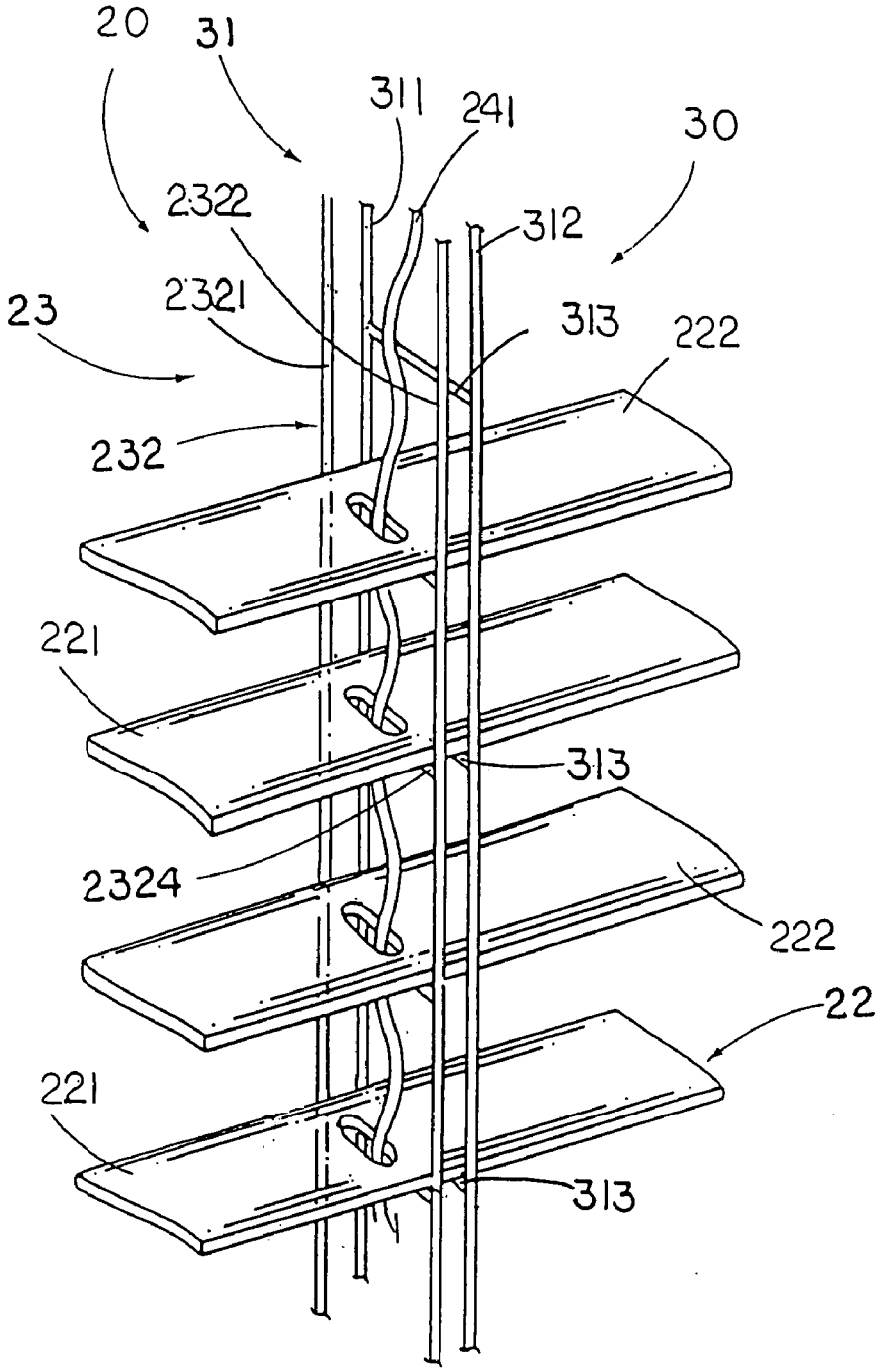
FIG. 2 is a partially perspective view of the window blind system according to the above preferred embodiment of the present invention illustrating the first hanging system and the second hanging system are commonly supporting the slats.

Referring to FIGS. 1 and 2 of the drawings, a window blind system according to a preferred embodiment of the present invention is illustrated, wherein the window blind system comprises a top traverse supporter 10 adapted for affixing to a top beam of a ceiling, a shading arrangement 20 and an alternation hanging device 30.

The shading arrangement 20 comprises a base member 21, a plurality of first and second slats 221, 222 aligning in a sequence manner, a slat hanging device 23 comprising a supporting element 232 extended from the top traverse supporter to spacedly and suspendedly support the first and second slats 221, 222 between the top traverse supporter 10 and the base member 21, and an operating unit 24 for selectively folding the first and second slats 221, 222 between a shading position and a folded position. In which, at the shading position, the base member 21 is dropped downwardly from the top traverse supporter 10 to allow the first and second slats 221, 222 spacedly supported therebetween for providing shading function and at the folded position, the base member 21 is lifted up to overlappedly fold the first and second slats 221, 222. Accordingly, a light passing gap G is defined between the first and second slats 221, 222 for allowing light passing therethrough.

The alternation hanging device 30 comprises an elongated hanging unit 31 extended from the top traverse supporter 10 to couple with the first slats 221 and an alternation-operating device 32 connected to the elongated hanging unit 31 to fold the first slats 221 to overlap with the second slats 222 respectively so as to double the light passing gap G therebetween.

According to the preferred embodiment of the present invention, the slat hanging device 23 and the alternation hanging device 30 are operated independently for coordinately controlling the first slats 221 so as to selectively allow a light of desirable intensity passing through from one side to another side of the window blinding system 1.

The elongate hanging unit 31 comprises two elongated cords 311, 312 downwardly extended from the top traverse supporter 10 at a position that the first and second slats 221, 222 are positioned between the two elongated cords 311, 312 and a plurality of slat seats 313 spacedly extended between the two elongated cords 311, 312 to support the first slats 221 respectively such that when the elongated cords 311, 312 are pulled upwardly, the first slats 221 are driven to lift up by the slat seats 313 to overlap underneath the second slats 222 respectively.

The supporting element 232 comprises two supporting cords 2321, 2322 downwardly extended from the top traverse supporter 10 at a position that the first and second slats 221, 222 are positioned between two elongated cords 2321, 2322 and a plurality of traverse cords 2324 spacedly extended between the two elongated cords 2321, 2322 to support the first and second slats 221, 222 respectively.

The window blind system further comprises a slat angle adjuster 231 coupling with the slat hanging device 23 to selectively adjust a tilt angle of each of the first slats 221 and the second slats 222, wherein the slat angle adjuster 231 comprises an angle rotor 2311 rotatably mounted at the top traverse supporter 10 to couple with the supporting element 232 such that when the angle rotor 2311 is driven to rotate, the supporting element 232 is pulled to tip each of the first and the second slats in an inclined manner.

According to the present invention, at least two supporting elements 232 vertically extended from two ends of the angle rotor 2311 for suspendedly supporting the first slats 221 and the second slats 222. Furthermore, the two supporting cords 2321, 2322 are extending from two ends of the angle rotor 2311 all the way to the first base member 21, and the plurality of traverse cords 2324 are spacedly extended between the first supporting cord 2321 and the second supporting cord 2322 to form a plurality of vertically and consecutively arranged first hanging grids 2325, wherein the first slats 221 and the second slats 222 are positioned between the first and second supporting cords 2321, 2322 and separated by the first hanging grids 2325.

In other words, the elongated supporting element 232 is a ladder shaped hanging system, wherein each slat 22, including the first slats 221 and the second slats 222, is supported by an individual traverse cord 2324 and spacedly separated by the first hanging grids 2325 with a distance of the length of the grids 2325, i.e. the gap G between the first slat 221 and the second slat 222. As a result, the first slats 221 and the second slats 222 can be rested and supported on the traverse cords 2324 respectively within the first hanging grid 2325.

Furthermore, the tilt angle of the slats 22 can be controlled by rotating the angle rotor 2311 to reversely lift up and drop down the first and second supporting cords 2321, 2322 at the same time. This is to say, the first supporting cord 2321 and the second supporting cord 2322 are reversely moved in a vertical direction so that the rotation of the angle rotor 2311 will lead to the variation of the tilt angle of the slats 221, 222 supported in the first hanging grid 2325. Accordingly, the first and second supporting cords 2321, 2322 are preferred to be integrally formed in one-piece member wherein lower ends of the first and second supporting cords 2321, 2322 are connected together to the base member 21.

The operating unit 24 comprises a lift lock 242 rotatably mounted on the top traverse supporter 10 and a pair of lift cords 241 each having a first end portion extended to the first base member 21. Each of the two lift cords 241 upwardly extends to penetrate through the slats 22 and then traversely extends through the top traverse supporter 10, wherein a second end portion of each of the lift cords 241 is extended out of the top traverse supporter 10 via the lift lock 242 to control the folding and unfolding of the shading arrangement 20. Accordingly, the lift cords 241 can integrally form in one piece member wherein the first end portions of the lift cords 241 are integrally connected together along the first base member 21 so as to enhance the folding and unfolding operations of the shading arrangement 20.

According to the preferred embodiment of the present invention, the first shading arrangement 20 is traditional shading arrangement containing a standard gap G defined between each of the first slats 221 and the second slats 222. That is to say, the distance between the traverse cords 2324 of the hanging device 23, from which the light is passed through, is the same as the gap of conventional window blind available on the market.

In the present invention, the alternating hanging device 30 is acted as a supplemental shading system for assisting the shading arrangement 20 to provide a varying shading effect. Here, the alternating hanging device 30 also comprises at least two hanging units 31 vertically extended from two ends of the angle rotor 2311 to the first base member 21 for supporting the first slats 221. Moreover, the hanging unit 31 comprises a first and second elongate cords 311 and 312, and a plurality of slat seats 313 spacedly extended between the two elongate cords 311, 312 to form a plurality of vertically and consecutively arranged second hanging grids 314, wherein the first slats 221 are positioned between the elongate cords 311, 312 and supported by the slat seats 313.

Furthermore, the alternation-operating device 32 comprises an actuation member 321 having an upper end attached to the hanging unit 31 to control the first slats and arranged in such a manner that the upper end of the actuation member 321 detachably couples to the angle rotor 2311 to control the tilt angles of the first and second slats 221, 222. In short, the alternation hanging device 30 further provides a double-purpose actuation member 321 for not only controlling the rotation of the angle rotor 2311 with respect to the top traverse supporter 10, but also for operating the hanging unit 31.

What is more, the alternation-operating device 32 comprises at least a pair of retaining cords 323 connected to the hanging unit 31 for lifting up the alternation hanging device 30, and a locking member provided on a side of the shading arrangement 20 to detachably engage with the actuation member 321 so as to securely lock up the first slats 221 overlapping with the second slats 222 respectively.

It is noted that the elongate cords 311, 312 upwardly extend to a front and back side of the angle rotor 2311 then the free end portions of the elongate cords 311, 312 are merged together to form the retaining cord 323 coupled with the actuation member 321 in the present invention. Through the retaining device 322, the user is able to lift up the retaining cord 323 and hold the alternation hanging device 30 in a lifted position. As a result, the vertical displacement of the alternation hanging device 30 is controllable thus ensuring the varying shading effects of the window blinding system 1. Here, it is worth to mention that the retaining device 323 could be embodied as an electrical device or a manual operable device.

According to the preferred embodiment of the present invention, each of the slats 22 is unexceptionally supported by the first hanging grids 2325 of the hanging device 23 At the same time, to ensure the window blind 1 are capable of fully blocking sunlight penetrating through, the height of each of the first hanging grid 2325, i.e. the gap G, is at least larger than the width of the each hanging grid 2325. That is to say that the distance between two adjacent traverse cords 2324 is shorter than the length of the traverse cord 2324 for ensuring the blocking effect.

It is noted that the first slats 221 are positioned between the two elongate cords 311, 312 and supported by both traverse cords 2324 and slat seat 3324. As described before, the elongate hanging unit 31 has a similar structure in comparison with the hanging device 23. Nevertheless, the difference is that the second hanging grid 314 has a different size in comparison with the first hanging grids 2325. According to the first preferred embodiment of the present invention, the length of the second hanging grids 314 (i.e. the distance between adjacent slat seats 313) is at least twice the length of the first hanging grids 2325(the distance between adjacent traverse cords 2324, gap G).

Figure 3:
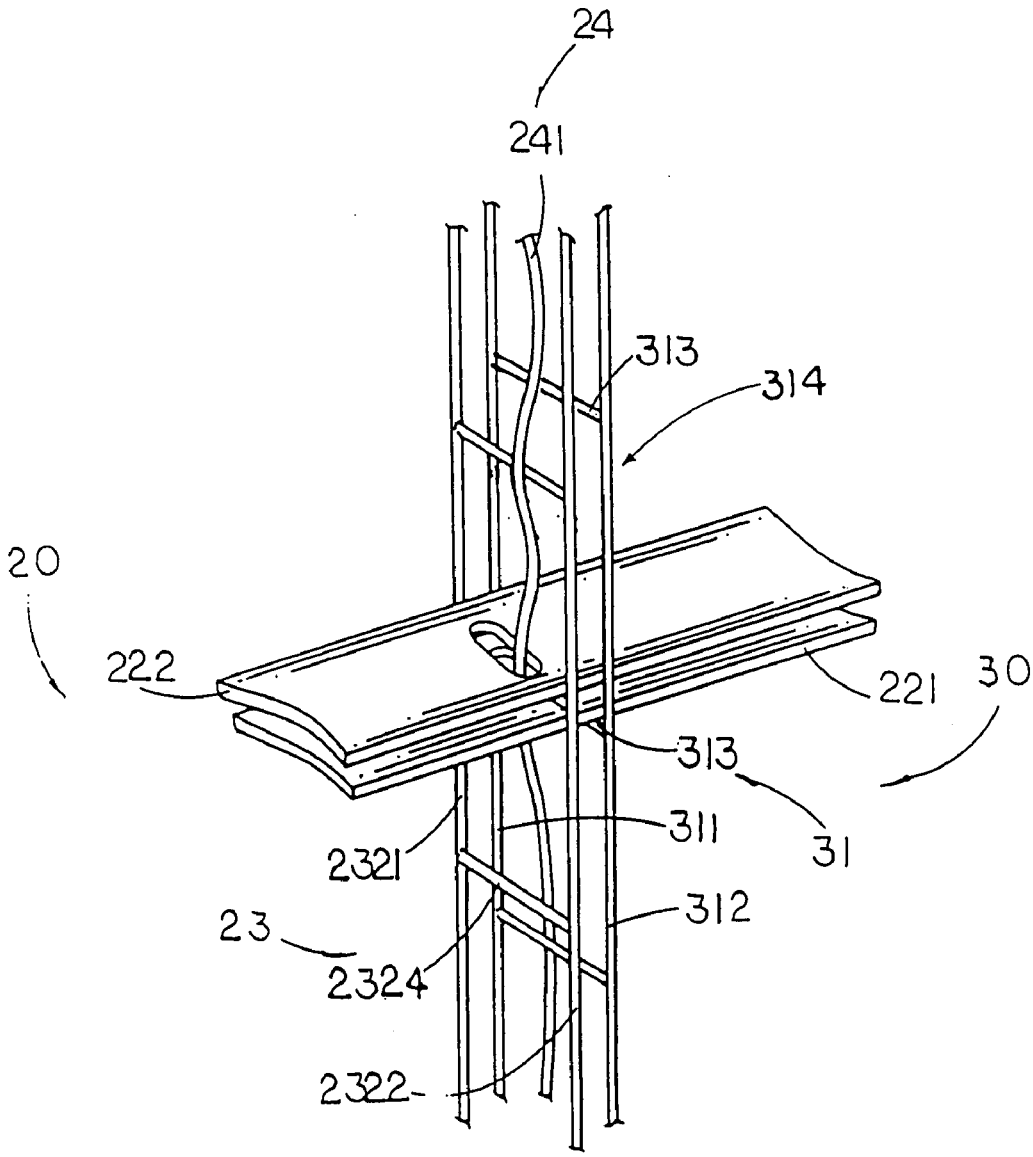
FIG. 3 is a partially perspective view of the window blind system according to the above preferred embodiment of the present invention illustrating after the second hanging system is lifted up, slats supported by the second hanging system are overlappedly adjacent to slats which are supported by the first hanging system.

As shown in FIG. 2 and FIG. 3, every single slat 22, (including the first and second slats 221, 222) is supported within the first hanging grid 2324 of the hanging device 23. Meanwhile, since the length of the second hanging grids 314 (i.e. the distance between adjacent slat seats 313) are at least twice the length of the first hanging grids 2325(the distance between adjacent traverse cords 2324, gap G) in the preferred embodiment, the area size of each of the second hanging grid 314 is twice as much as the area size of the first hanging grid 2325. In other words, the size of the second hanging grid 314 equals to a size combining two vertically connected first hanging grids 2325. Therefore, the slats 22 are supported by the hanging device 23 and hanging unit 31 simultaneously, only the first slats 221 are supported by both traverse cords 2324 of the hanging device 23 and the slat seat 313 of the hanging unit 31 as shown in FIG. 2. Accordingly, the second slats 222 are only supported by traverse cords 2324 of the hanging device 23. This is to say that every other slat 22, the first slat 221, is supported by both hanging device 23 and hanging unit 31.

For instance, if the slats 22 are divided into two sets, namely, even numbered first slats 221 and odd numbered second slats 222, only one set of the slats 22 are supported by both hanging device 23 and hanging unit 31. As a result, if the hanging unit 31 is lifted by the retaining cord 323, the first slats 221 supported by the hanging unit 31 will be lifted until the first slats 221 are overlapped with the second slats 222 which are not supported by the hanging unit 31. Since every two adjacent slats 22 are overlapped, sunlight are allowed through from a gap twice as the size of conventional gap G as shown in FIG. 3.

Conclusively, the slats 22 of the shading arrangement 20 are supported by both the hanging device 23 and the hanging unit 31. The hanging unit 31 of the alternation hanging device 30 is functioned as an auxiliary means for only supporting the first slats 221. In the preferred embodiment, every single second slat 222 not supported by the hanging unit 31 must be adjacent to a first slat 221 supported by the hanging unit 31. So, the second slats 222 not supported by the hanging unit 23 and the first slats 221 supported by the hanging unit 31 are vertically disposed from the top traverse supporter 10 to the base member 21 in an alternating manner.

Figure 4:
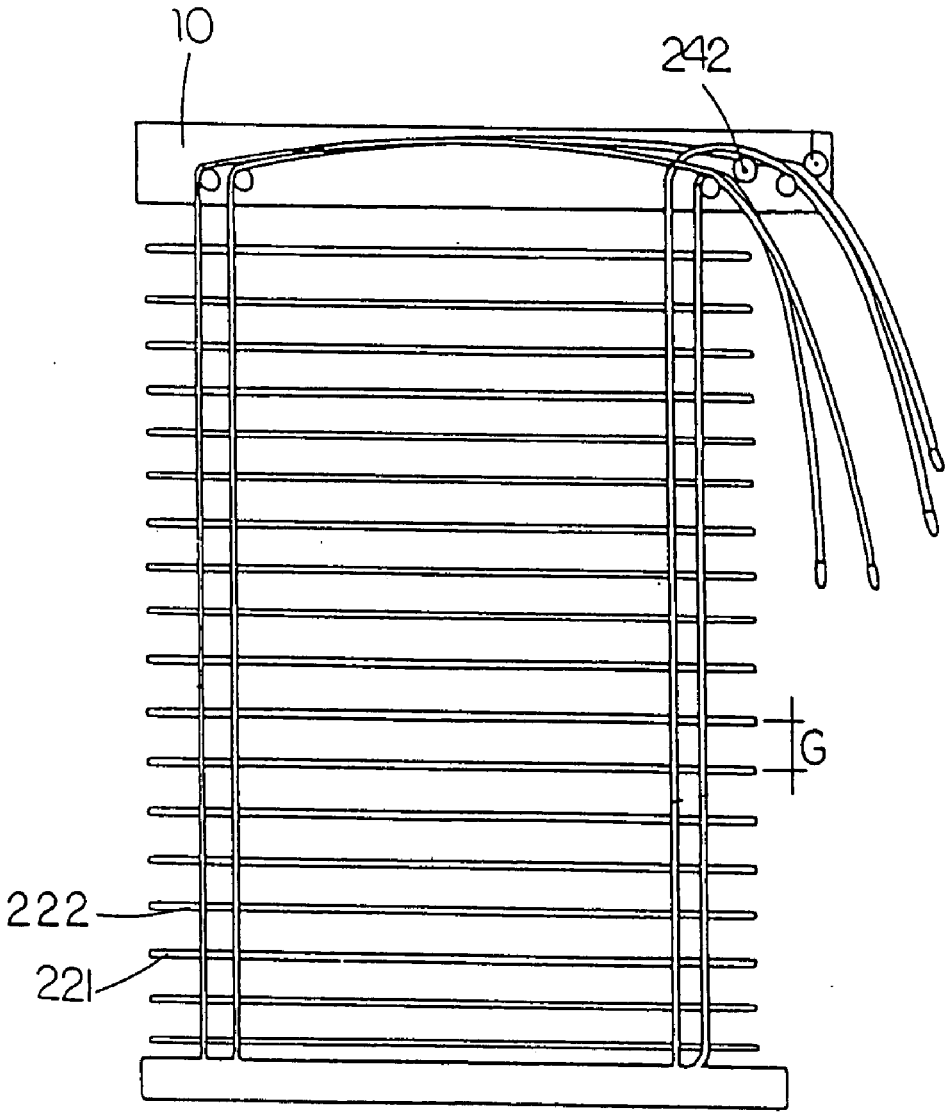
FIG. 4 is a schematic view of the window blind system according to the above preferred embodiment of the present invention, illustrating when the second hanging system is not lifted, the shading effect of the window blinding system are same as the conventional window blinds.
Figure 5:
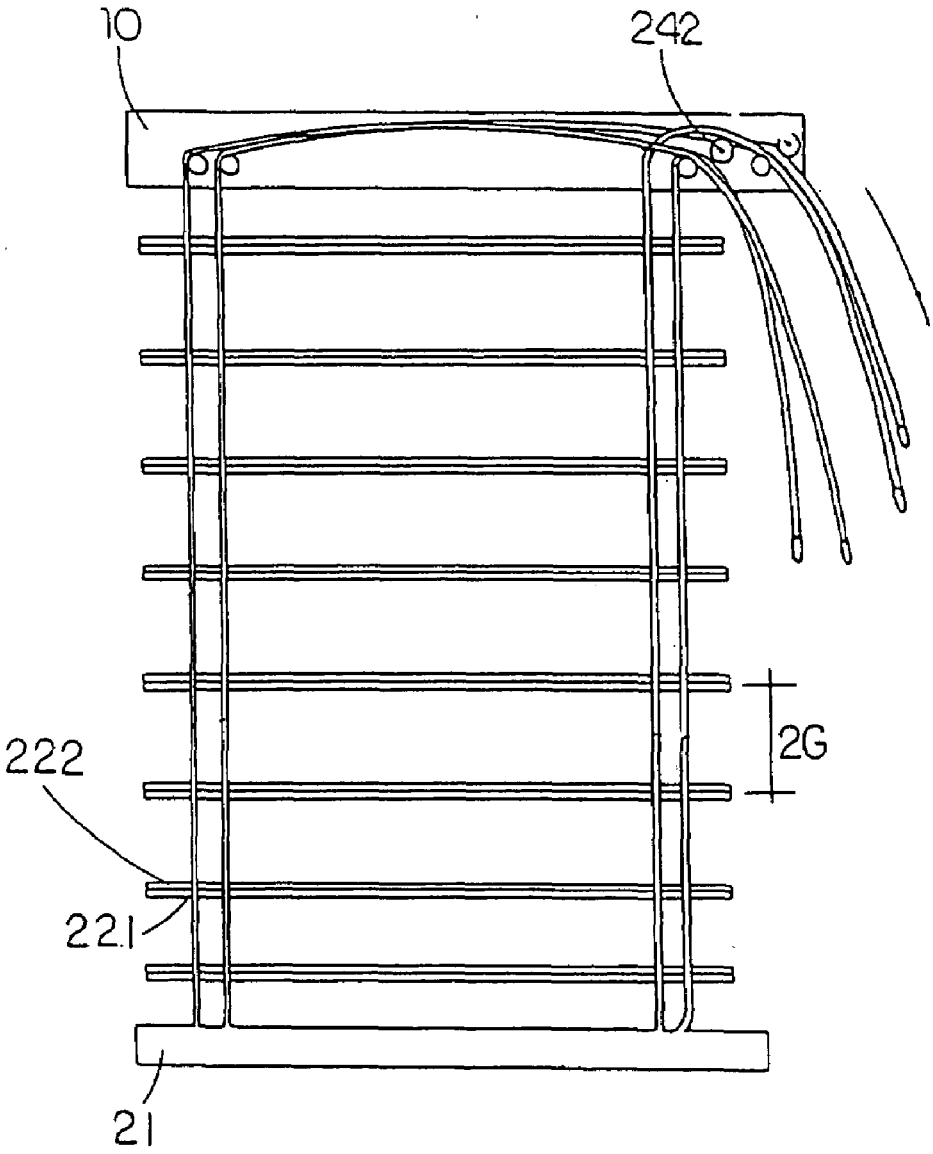
FIG. 5 is a schematic view of the window blind system according to the above preferred embodiment of the present invention, illustrating when the second hanging system is lifted, the light are able to pass through the window blind in a gap twice as the size of the conventional window blinds.

As described before, the shading arrangement 20 is just embodied as a conventional window blind. So, the appearance and the function of the window blind of the present invention shows no difference compared with conventional window blind. Sunlight is allowed through the window blind from a normal gap G which is the distance between adjacent traverse cords 2324 as shown in FIG. 4. However, since the length of the second hanging grids 314 (i.e. the distance between adjacent slat seat 313) are at least twice the length of the first hanging grids 2325 (the distance between adjacent traverse cords 2324, gap G) in the preferred embodiment, the lifted hanging unit 31 will displace the first slats 221 supported by hanging unit 31 upward to overlap with the second slats 222. Finally, sunlight will be allowed through the window blind from a gap 2G which is the distance between adjacent slat seats as shown in FIG. 5. Thereby, the window blind in the present invention provides a function by which a user is able to choose desirable sunlight intensity through the window blind.

What is more, the hanging unit 31 is merely another hanging device having a larger grids size. The assembling process of the window blind of the present invention is convenient and simple. The manufacturers are least likely to worry about installing two shading arrangement and complicated assembling process. In short, the present invention is just provide a supplemental hanging net to conventional window blind to achieve a varying shading effect as above mentioned multifunctional shading device. However, this amended window blind is compatible with standardized components of conventional window blinds, easy to assemble, and efficient.

Figure 7:
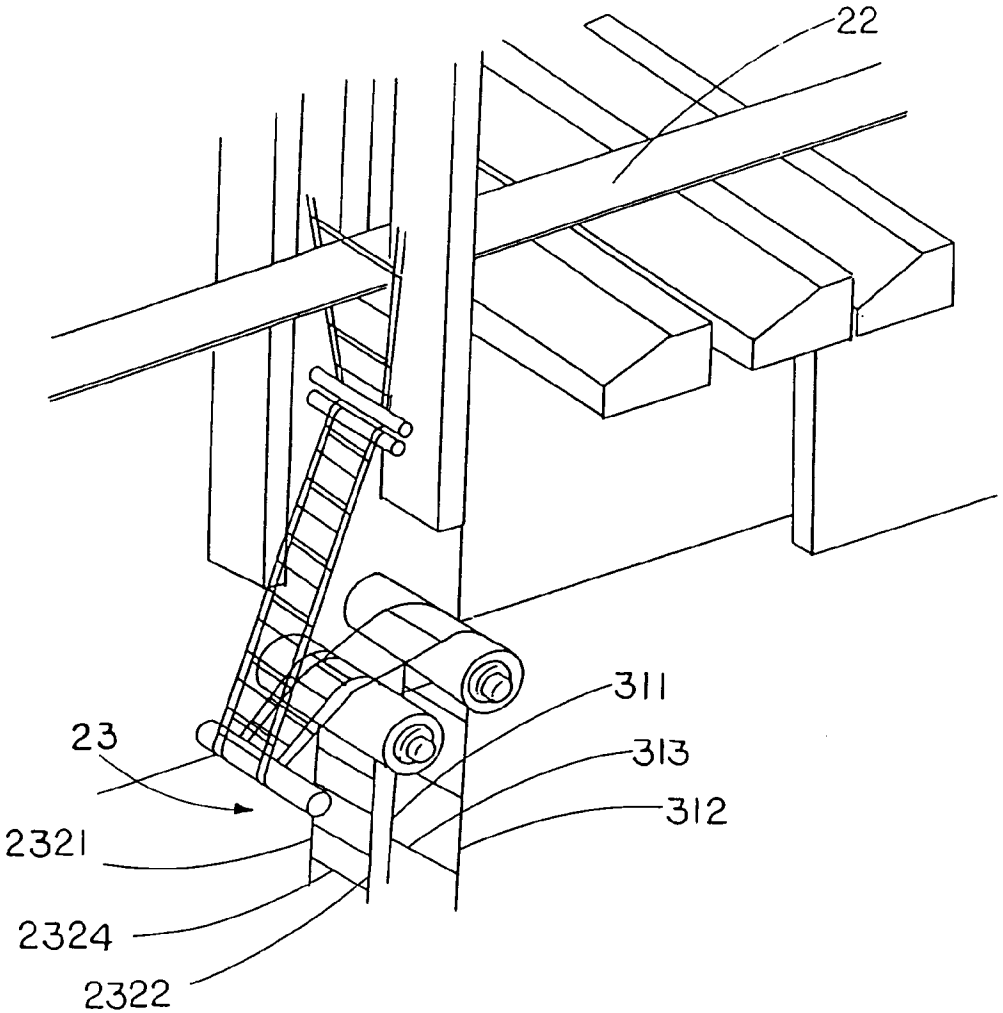
FIG. 7 is a perspective view demonstrating an assembling process of the ladder-shaped hanging net being hanged and arranged with respect to a slat according to the preferred embodiment of the present invention.

As shown in the FIG. 7, the ladder shaped hanging device 23 is hanged and arranged to a window blind assembling machine. The hanging device 23 is adapted to be vertically shifted with a predetermined rhythm, so that during each of the moving interval, a slat 22 is capable being inserted into the first hanging grid 2325 of the hanging device 23. According to the present invention, the hanging unit 31 of the alternation hanging device 30 and the hanging device 23 could be hanged and arranged together. This is due to the fact that the hanging unit 31 has an identical ladder shape and a similar structure. Since the second hanging grid 314 is twice the size of the first hanging grid 2325, half set of the traverse cord 2324 and the slat seats 313 could be aligned during the assembly process. In other words, when every two moving intervals are upwardly shifted, a second hanging grid 314 will be upwardly shifted as well.

Figure 6:
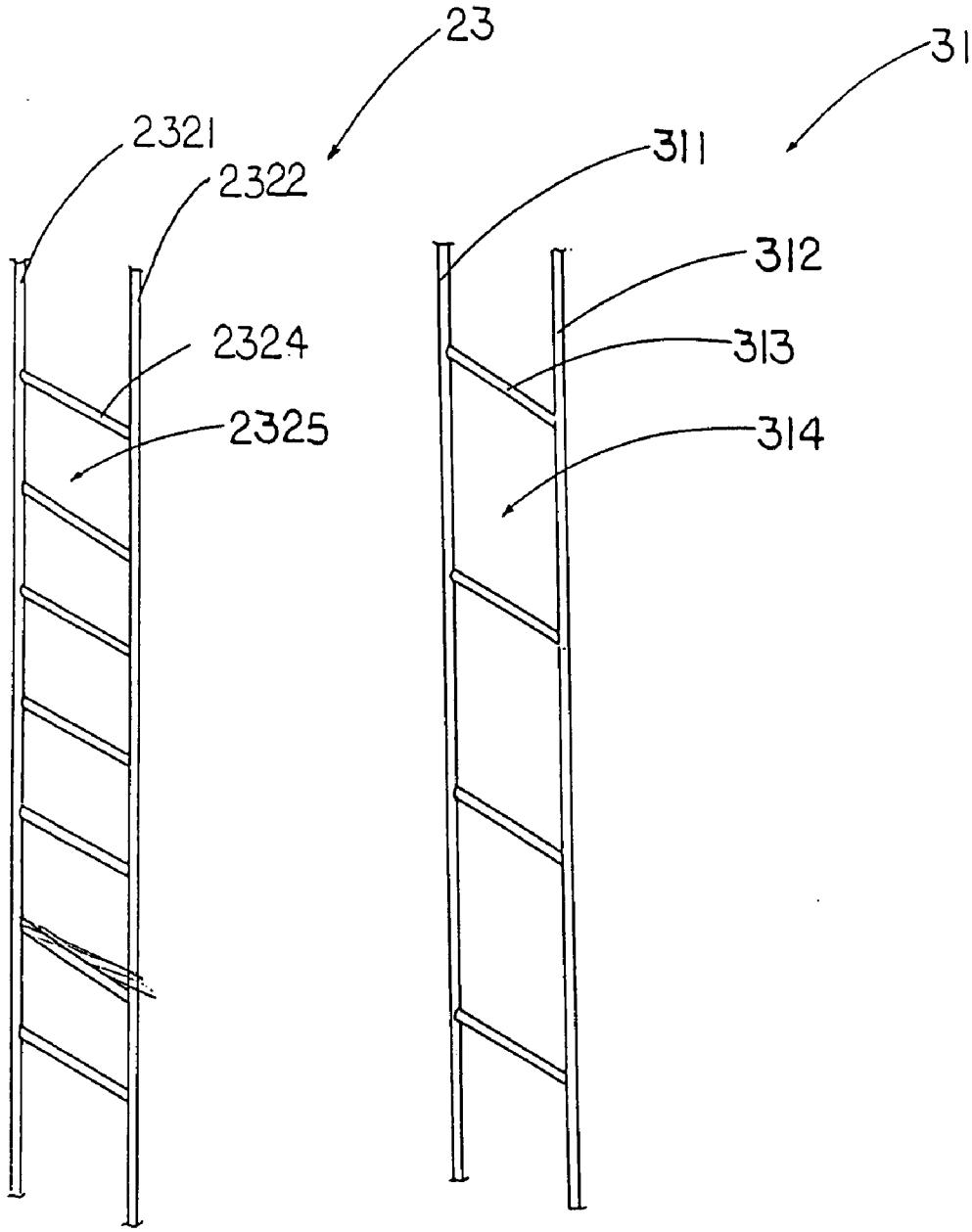
FIG. 6 is a perspective view of the window blind system according to the above preferred embodiment of the present invention, showing the first hanging system and the second hanging system.

Referring to the *fig*. 8, the alternating-operating system 32 for adjusting the tilt angle of slats 22 and for lifting up the hanging unit 31 as in FIG. 6 of the preferred embodiment of the present invention are illustrated. To achieve an efficient and effective maneuverability, the alternating-operating system 32 comprises an actuating member 321 coupled with the retaining cords 323 for controlling the alternation shading arrangement 30 in the present invention.

As know in the art, by rotating an adjusting rod, the angle rotor 2311 rotatably mounted on the top traverse supporter 10 are capable of rotating with respect to the top traverse supporter 10. Commonly, there is a fixed gear truck provided on one end of the angle rotor 2311, and a rotatable hook is protruded from the gear truck for detachably coupling the adjusting rod. Accordingly, the top end of the adjusting rod is provided with a loop element for detachably engaging with the rotatable hook. Therefore, by rotating the adjusting rod, the rotatable hook will be rotated as well thus driving the gear truck to rotating the angle rotor 2311 into rotation.

According to the preferred embodiment of the present invention, the slat angle adjuster 231 has a non-circular engaging groove 2312 protruded from a gear truck 2313 coupled one end of the angle rotor 2311, and the upper end of the actuating member 321 has a corresponding non-circular cross section such that the upper end of the actuating member 321 is detachably inserted into the engaging groove 2312 to rotate the angle rotor 2311 so as to selectively adjust said tilt angles of the first and second slats 221, 222.

In other words, the actuating member 321 is capable of not only uplifting the alternation shading device 30 to adjust the shading effect, but also controlling the tilt angle of each slat 22.

Figure 8:
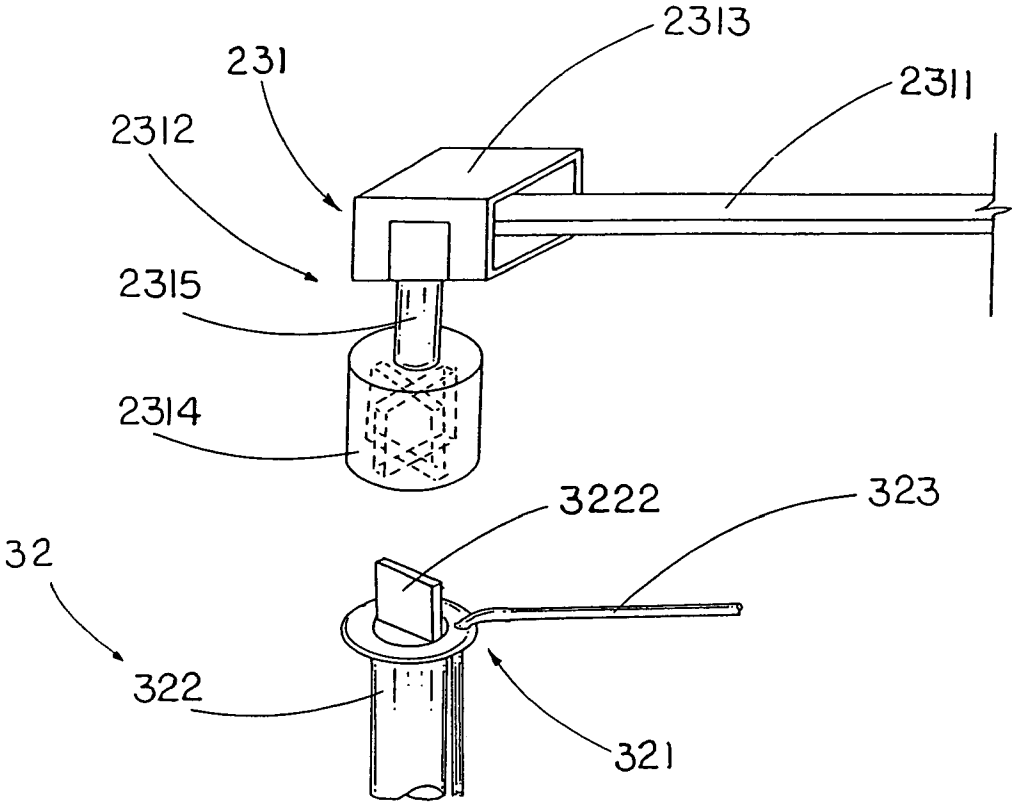
FIG. 8 is a perspective view illustrating the comparison of the conventional rotating means for adjusting the slat tilt angle and the rotating means according to the first preferred embodiment of the present invention.

As shown in the FIG. 8, the engaging groove 2312 is defined by a cylindrical housing 2314 and an elongated shaft 2315 integrally extended from a top side of the cylindrical housing 2314 so as to rotatably connect with a gear truck 2313, while the cylindrical housing 2314 further has an engaging slot defined on its bottom side, so that by inserting an engaging end of the actuating member 321, the rotational actuating member 321 is capable of driving the engaging groove 2312 into rotation so as to subsequently rotate the angle rotor 2311 into action.

Figure 9:
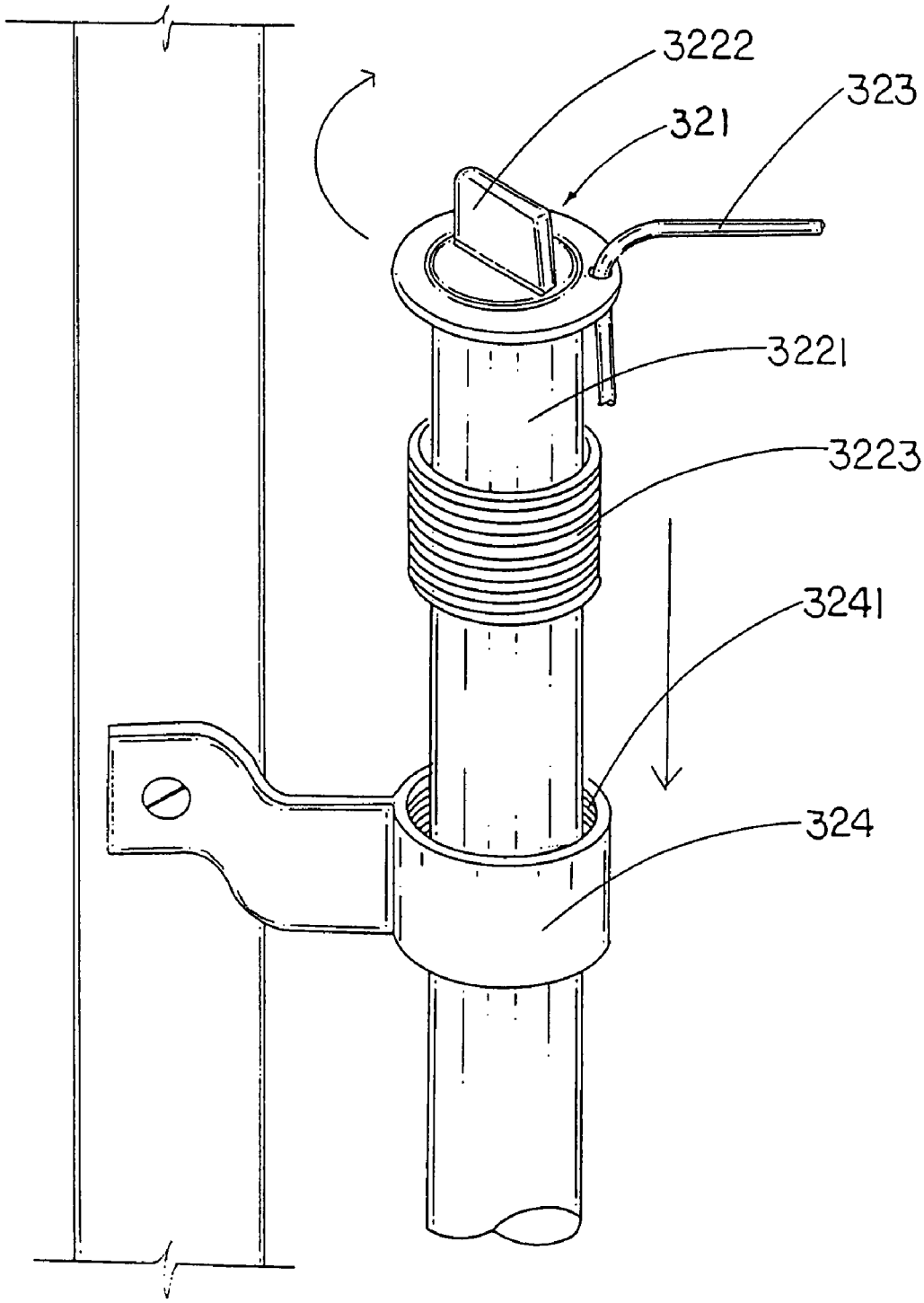
FIG. 9 is a perspective view of the retaining means for controlling the lifting movement of the second hanging system according to the first preferred embodiment of the present invention.

As shown in FIG. 9, the actuating member 321 according to the first preferred embodiment of the present invention is illustrated. The actuating member 321 comprises an elongated shaft 3221, and a blade head 3222 defined on a top end of the elongated shaft 3221, the blade head 3222 is adapted for inserting into the engaging groove 2312 for driving the angle rotor 2311 into rotation. It is noted that the engaging groove 2312 has a substantial depth to ensure the blade head 3222 is fully and securely received therein. Preferably, the engaging groove 2312 is cross profiled, so that the blade head 3222 of the actuating member 321 could be easily inserted without a substantial alignment.

As shown in FIG. 9, the actuating member 321 further comprises an outer locking threaded portion 3223 positioned on a predetermined middle position on the elongated shaft 3221, and the locking member 324 comprises a locker ring 3241, which is adapted for mounting on a side of a window frame, having an inner locking threaded portion which is shaped and sized matching with the outer locking threaded portion 3223, after a user pulls down the actuating member 321 to lift up the alternation hanging device, the outer locking threaded portion 3223 is capable of engaging with the locking member 324 so as to lock the displacement of the hanging unit 31 with respect to the shading arrangement 20.

Preferably, the retaining cord 323 is coupled to a rotatable edge defined on the actuating member 321. Therefore, if the user wishes to adjust the tilt angle of slats 22, he or she could insert the actuating member 321 into the engaging groove 2312, then rotate the angle rotor 2311 to adjust the tilt angle of slats 22, further, he or she could pull down the actuating member 321 to lift up the hanging unit 31 allowing lights penetrate through the window blind from a wider gap 2G. Finally, he or she could rotate the actuating member 321 to engage with locking member 324 to hold the displacement.

According to the first preferred embodiment of the present invention, the top traverse supporter 10 has a U-shaped cross section comprises two guiding shafts 11 transversely and spacedly extended between two inner walls of said top traverse supporter 10, wherein the hanging unit 31 is upwardly extended through a bottom wall of the top traverse supporter 10 to slidably engage with two guiding shafts 11 for minimizing a friction between the guiding shafts 11 and the hanging unit 31 when the hanging unit 31 is pulled upwardly to fold the first slats 221.

Here, the two guiding shafts 11 are functioned as abrasion proof members provided within the top traverse supporter 10 for prolonging the lifespan of the retaining cord 323. The top traverse supporter 10 is U-shaped defined so that the angle rotor 2311 is rotatably received therein for adjusting the tilt angle of the slats 22. For the convenient reason, a plurality of central slots are defined on the bottom side of the top traverse supporter 10, so that the supporting cords or retaining cords for operating the blind could be penetrated through. Within the art, there is only one abrasion proof member, commonly made of metal materials, are alignedly defined above the central slots so that the retaining cords 323 for lifting up the base member towards the top traverse supporter 10 could slip along the abrasion proof members.

Figure 10:
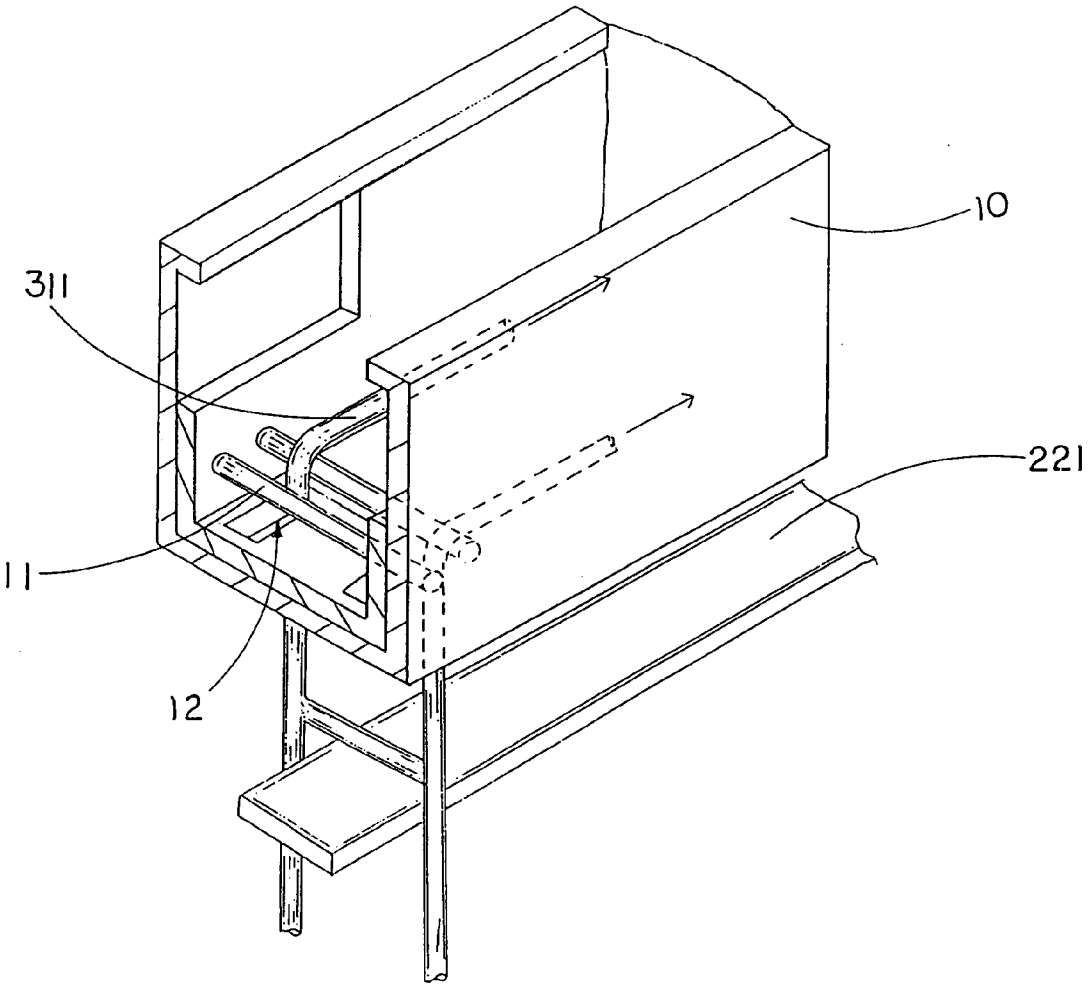
FIG. 10 is perspective view of showing the abrasion-proof member defined within the top traverse supporter for prolong the lifespan of the retaining cords.

According to the present invention, the retaining cord 323 is adapted for uplifting the hanging unit 31. As result, two corresponding edge slots 12 are defined on the edge portion of the bottom side of the top traverse supporter 10 as show in the FIG. 10 for penetrating the elongate cords 311, 312. As a result, the two guiding shafts 11 are provided transversely the top traverse supporter 10 for covering the two edge slots 12.

In other words, the traditional one abrasion proof member which is shortly defined above the central slot for penetrating the retaining cord 323, the pair of guiding shafts 11 are provided spanning across the top traverse supporter 10 for penetrating the elongate cords 311, 312 from two edge portion.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A window blind system, comprising:

a top traverse supporter;

a shading arrangement comprising a base member, a plurality of first and second slats aligning in a sequence manner, a slat hanging device comprising a supporting element extended from said top traverse supporter to spacedly and suspendedly support said first and second slats between said top traverse supporter and said base member, and an operating unit for selectively folding said first and second slats between a shading position and a folded position, wherein a light passing gap is defined between said first and second slats for allowing light passing therethrough;

an alternation hanging device comprising an elongated hanging unit extended from said top traverse supporter to couple with said first slats and an alternation-operating device connected to said hanging unit to raise said first slats to overlap with said second slats respectively so as to double said light passing gap therebetween, wherein said hanging unit comprises two elongated cords downwardly extended from said top traverse supporter at a position that said first and second slats are positioned between said two elongated cords and a plurality of slat seats spacedly extended between said two elongated cords to support said first slats respectively such that when said elongated cords are pulled upwardly, said first slats are driven to lift up by said slats seats to overlap underneath said second slats respectively, wherein said supporting element comprises two supporting cords downwardly extended from said top traverse supporter at a position that said first and second slats are positioned between said two elongated cords and a plurality of traverse cords spacedly extended between said two elongated cords to support said first and second slats respectively, wherein a distance between each two said slat seats is double to a distance between each two said traverse cords; and a slat angle adjuster coupling with said slat hanging device to selectively adjust a tilt angle of each of said first and second slats, wherein said slat angle adjuster comprises an angle rotor rotatably mounted at said top traverse supporter to couple with said supporting element such that when said angle rotor is driven to rotate, said supporting element is pulled to tip each of said first and second slats in an inclined manner, wherein said alternation-operating device comprises an actuation member having an upper end attached to said hanging unit to control said first slats and arranged in such a manner that said upper end of said actuation member detachably couples to said angle rotor to control said tilt angles of said first and second slats, wherein said alternation-operating device further comprises a locking member provided on a side of said shading arrangement to detachably engage with said actuation member so as to securely lock up said first slats overlapping with said second slats respectively, wherein said locking member comprises a locker ring, which is adapted for mounting on a side of a window frame, having an inner locking threaded portion, wherein said actuation member is slidably engaged with said locker ring and has an outer locking threaded portion arranged to engage with said inner locking threaded portion of said locker ring so as to lock up said actuation member with said locker ring.

2. A window blind system, comprising:

a top traverse supporter;

a shading arrangement comprising a base member, a plurality of first and second slats aligning in a sequence manner, a slat hanging device comprising a supporting element extended from said top traverse supporter to spacedly and suspendedly support said first and second slats between said top traverse supporter and said base member, and an operating unit for selectively folding said first and second slats between a shading position and a folded position, wherein a light passing gap is defined between said first and second slats for allowing light passing therethrough;

an alternation hanging device comprising an elongated hanging unit extended from said top traverse supporter to couple with said first slats and an alternation-operating device connected to said hanging unit to raise said first slats to overlap with said second slats respectively so as to double said light passing gap therebetween, wherein said hanging unit comprises two elongated cords downwardly extended from said top traverse supporter at a position that said first and second slats are positioned between said two elongated cords and a plurality of slat seats spacedly extended between said two elongated cords to support said first stats respectively such that when said elongated cords are pulled upwardly, said first slats are driven to lift up by said slats seats to overlap underneath said second slats respectively, wherein said supporting element comprises two supporting cords downwardly extended from said top traverse supporter at a position that said first and second slats are positioned between said two elongated cords and a plurality of traverse cords spacedly extended between said two elongated cords to support said first and second slats respectively, wherein a distance between each two said slat seats is double to a distance between each two said traverse cords; and a slat angle adjuster coupling with said slat hanging device to selectively adjust a tilt angle of each of said first and second slats, wherein said slat angle adjuster comprises an angle rotor rotatably mounted at said top traverse supporter to couple with said supporting element such that when said angle rotor is driven to rotate, said supporting element is pulled to tip each of said first and second slats in an inclined manner, wherein said alternation-operating device comprises an actuation member having an upper end attached to said hanging unit to control said first slats and arranged in such a manner that said upper end of said actuation member detachably couples to said angle rotor to control said tilt angles of said first and second slats, wherein said angle rotor has a non-circular engaging groove and said upper end of said actuation member has a corresponding non-circular cross section such that said upper end of said actuation member is detachably inserted into said engaging groove to rotate said angle rotor so as to selectively adjust said tilt angles of said first and second slats, wherein said alternation-operating device further comprises a locking member provided on a side of said shading arrangement to detachably engage with said actuation member so as to securely lock up said first slats overlapping with said second slats respectively, wherein said locking member comprises a locker ring, which is adapted for mounting on a side of a window frame, having an inner locking threaded portion, wherein said actuation member is slidably engaged with said locker ring and has an outer locking threaded portion arranged to engage with said inner locking threaded portion of said locker ring so as to lock up said actuation member with said locker ring.

3. The window blind system, as recited in claim 2, wherein said top traverse supporter having a U-shaped cross section comprises two guiding shafts transversely and spacedly extended between two inner walls of said top traverse supporter, wherein said hanging unit is upwardly extended through a bottom wall of said top traverse supporter to slidably engage with said two guiding shafts for minimizing a friction between said guiding shafts and said hanging unit when said hanging unit is pulled upwardly to fold said first slats.

* * * * *